US011454012B2

(12) United States Patent
Parker

(10) Patent No.: US 11,454,012 B2
(45) Date of Patent: Sep. 27, 2022

(54) FLUSH ASSEMBLY FOR TOILET

(71) Applicant: Peter Mario Parker, Baraboo, WI (US)

(72) Inventor: Peter Mario Parker, Baraboo, WI (US)

(73) Assignee: Peter M. Parker, Baraboo, WI (US)

( * ) Notice: Subject to any disclaimer, the term of this patent is extended or adjusted under 35 U.S.C. 154(b) by 0 days.

(21) Appl. No.: 17/336,553

(22) Filed: Jun. 2, 2021

(65) Prior Publication Data

US 2021/0395987 A1 Dec. 23, 2021

Related U.S. Application Data

(60) Provisional application No. 63/033,414, filed on Jun. 2, 2020.

(51) Int. Cl.
*E03D 1/26* (2006.01)
*E03D 5/094* (2006.01)

(52) U.S. Cl.
CPC ..... *E03D 1/263* (2013.01); *E03D 5/094* (2013.01)

(58) Field of Classification Search
CPC ..... E03D 1/263; E03D 1/26; E03D 5/092
USPC ..... 4/421
See application file for complete search history.

(56) References Cited

U.S. PATENT DOCUMENTS

| | | | | |
|---|---|---|---|---|
| 2,700,163 | A * | 1/1955 | Sturman | E03D 1/125 137/446 |
| 3,280,407 | A | 10/1966 | Aaron | |
| 3,461,465 | A * | 8/1969 | Fisher | E03D 1/025 4/353 |
| 4,034,423 | A * | 7/1977 | Milnes | E03D 5/024 4/375 |
| 5,548,849 | A | 8/1996 | Sulit | |
| 6,397,404 | B1 | 6/2002 | Ferreyra et al. | |
| 6,584,622 | B1 | 7/2003 | Nilsson | |
| 6,925,658 | B2 | 8/2005 | Parker | |
| 7,185,374 | B2 | 3/2007 | Rodriguez | |
| 9,476,191 | B2 * | 10/2016 | Kitaura | E03D 1/263 |
| 9,476,193 | B2 * | 10/2016 | Kitaura | E03D 5/01 |
| 10,428,502 | B2 | 10/2019 | Parker | |
| 2008/0209621 | A1 | 9/2008 | Tilson et al. | |

FOREIGN PATENT DOCUMENTS

| | | | |
|---|---|---|---|
| WO | 2019067565 | A1 | 4/2019 |
| WO | 2020060999 | A1 | 3/2020 |

* cited by examiner

*Primary Examiner* — Huyen D Le

(57) ABSTRACT

A flush assembly for a toilet with a tank can include a rigid siphon body with a siphon inlet, a siphon outlet, and a siphon passage. An outlet assembly can be coupled to the siphon outlet to provide a liquid flow path between the siphon outlet and a flush port of the tank. The rigid siphon body can be configured to float within the tank and to be submerged to establish a siphon-driven flow of liquid from the tank to the flush port to flush the toilet.

20 Claims, 9 Drawing Sheets

FLUSH ASSEMBLY FOR TOILET

CROSS REFERENCE TO RELATED APPLICATIONS

This application claims priority to similarly-titled provisional patent application No. 63/033,414, filed Jun. 2, 2020, the entirety of which is incorporated herein by reference.

STATEMENT OF FEDERALLY SPONSORED RESEARCH OR DEVELOPMENT

Not applicable.

FIELD OF THE DISCLOSURE

This disclosure relates to toilets, including toilets configured for operation by gravity-driven water flows from elevated tanks.

BACKGROUND OF THE DISCLOSURE

Conventional toilets include a toilet tank with an internal flush port (e.g., flanged tank opening) at the bottom thereof. A flapper resting on top of the flush port generally forms a seal to stop the flow of water through the flush valve. When a toilet handle outside the tank is manually activated, the flapper is lifted, thereby allowing water to flow through the flush port and into a toilet bowl to flush the toilet. However, degradation in the flapper and/or the flush port can result in degeneration of the seal between the two components, leading to undesired leakage of water from the tank.

SUMMARY OF THE DISCLOSURE

Embodiments of the invention can include a flush assembly for a toilet, which may be useful in reducing leakage from a toilet tank.

According to one embodiment of the invention, a flush assembly is provided for a toilet with a tank that includes a flush port and a flush handle. The flush assembly can include a siphon body with a siphon inlet, a siphon outlet, and a siphon passage. An outlet assembly can be coupled to the siphon outlet and a drain fitting can be coupled to the outlet assembly. The drain fitting can be configured to be coupled to the tank at the flush port. The drain fitting can have a set of arm extending radially outward therefrom and each arm can have a hole. A flush cable can pass through the holes of the set of arms and coupled to the flush handle and the inlet assembly at each end of the flush cable. The siphon body can be configured to float within the tank and, during a flushing sequence, to be submerged to establish a siphon-driven flow of liquid from the tank to the flush port to flush the toilet via, successively, flow through the siphon inlet, the siphon passage, the siphon outlet, the outlet assembly, and the drain fitting.

According to one embodiment of the invention, a flush assembly is provided for a toilet with a tank that includes a flush port and a flush handle. The flush assembly can include a siphon body with a siphon inlet, a siphon outlet, and a siphon passage. An outlet assembly can be coupled to the siphon outlet to direct flow from the siphon outlet to the flush port. The outlet assembly can include an expandable bellows. A depth stop can be coupled to the siphon inlet. The siphon body can be configured to float within the tank and, during a flushing sequence, to be submerged to establish a siphon-driven flow of liquid from the tank to the flush port to flush the toilet via, successively, flow through the siphon inlet, the siphon passage, the siphon outlet, and the outlet assembly. The depth stop can be adjustable relative to the siphon body to modify a minimum distance between the siphon inlet and a floor of the tank when the siphon body is submerged during the flushing sequence.

According to one embodiment of the invention a flush assembly is provided for a toilet with a tank that includes a flush port and a flush handle. The flush assembly can include a siphon body with a siphon inlet, a siphon outlet, and a siphon passage. An outlet assembly can be coupled to the siphon outlet to direct flow from the siphon outlet to the flush port. The outlet assembly can include an expandable bellows. The flush assembly can also include a refill port. The siphon body can be configured to float within the tank and, during a flushing sequence, to be submerged to establish a siphon-driven flow of liquid from the tank to the flush port to flush the toilet via, successively, flow through the siphon inlet, the siphon passage, the siphon outlet, the outlet assembly, and the drain fitting. The refill port can be configured to refill the tank after cessation of the siphon-driven flow, without directing a refill flow directly into an overflow tube of the tank.

The details of some embodiments of the invention are set forth in the accompanying drawings and the description below, along with certain features and advantages. Other embodiments, and other features and advantages, will be apparent from the description, the drawings, and the claims.

BRIEF DESCRIPTION OF THE DRAWINGS

Like reference numerals in the drawings indicate like components, parts, or operations.

DETAILED DESCRIPTION

Figure 1:
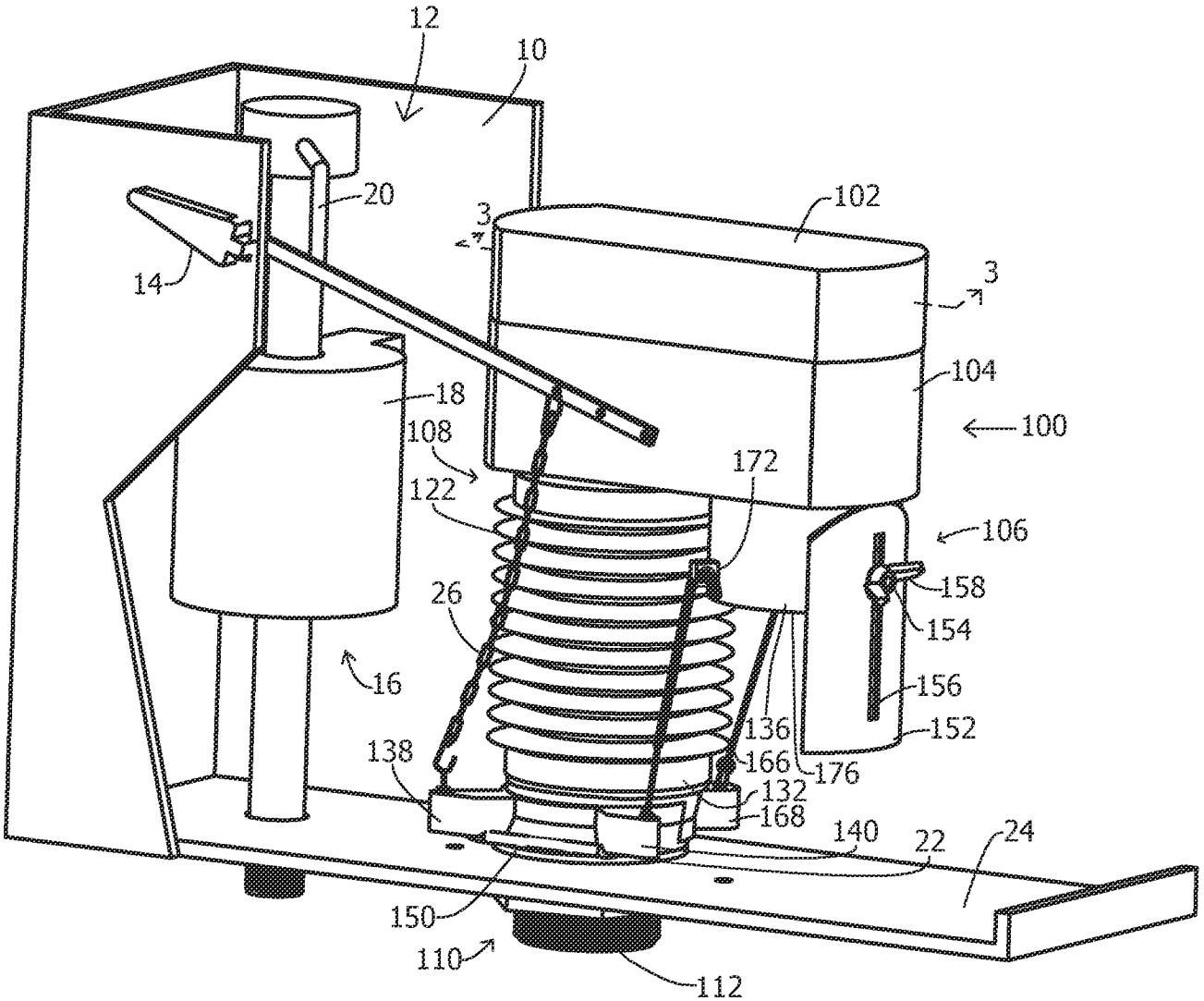
FIGS. 1 and 2 are isometric views of a flush assembly according to an embodiment of the invention, installed in a toilet tank.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless specified or limited otherwise, the terms "mounted," "connected," "supported," "coupled," and variations thereof are used broadly and encompass both direct and indirect mountings, connections, supports, and couplings. Further, "connected" and "coupled" are not restricted to physical or mechanical connections or couplings.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that any use of terms "comprises" and/or "comprising" in this specification specifies the presence of stated features, integers, steps, operations, elements, and/or components, but do not preclude the presence or addition of one or more other features, integers, steps, operations, elements, components, and/or groups thereof.

As used herein, unless otherwise defined or limited, directional terms are used for convenience of reference for discussion of particular figures or examples. For example, references to downward (or other) directions may be used to discuss aspects of a particular example or figure, but do not necessarily require similar orientation or geometry in all installations or configurations.

As used herein, unless otherwise defined or limited, "flexible" indicates a feature that is configured to be bendable, compressible, bendable and compressible, or otherwise deformable.

As noted above, conventional flush assemblies for toilets can include flush valves that are sealed by flappers, which can be prone to leakage. Embodiments of the invention can address this issue, or others. For example, some embodiments of the invention can provide a flush assembly that relies on establishing a siphon between an elevated tank and a toilet bowl to move water from a toilet tank into a toilet bowl. In some cases, this can eliminate the need for a flapper and the corresponding likelihood of undesired leakage. Further, some embodiments of the invention can include siphon mechanisms that can be readily manufactured and assembled, without requiring bending of siphon tubes. As another potential benefit, some embodiments can result in more efficient refilling of a toilet bowl or a toilet tank after a flush than may be possible with conventional designs.

Figure 2:
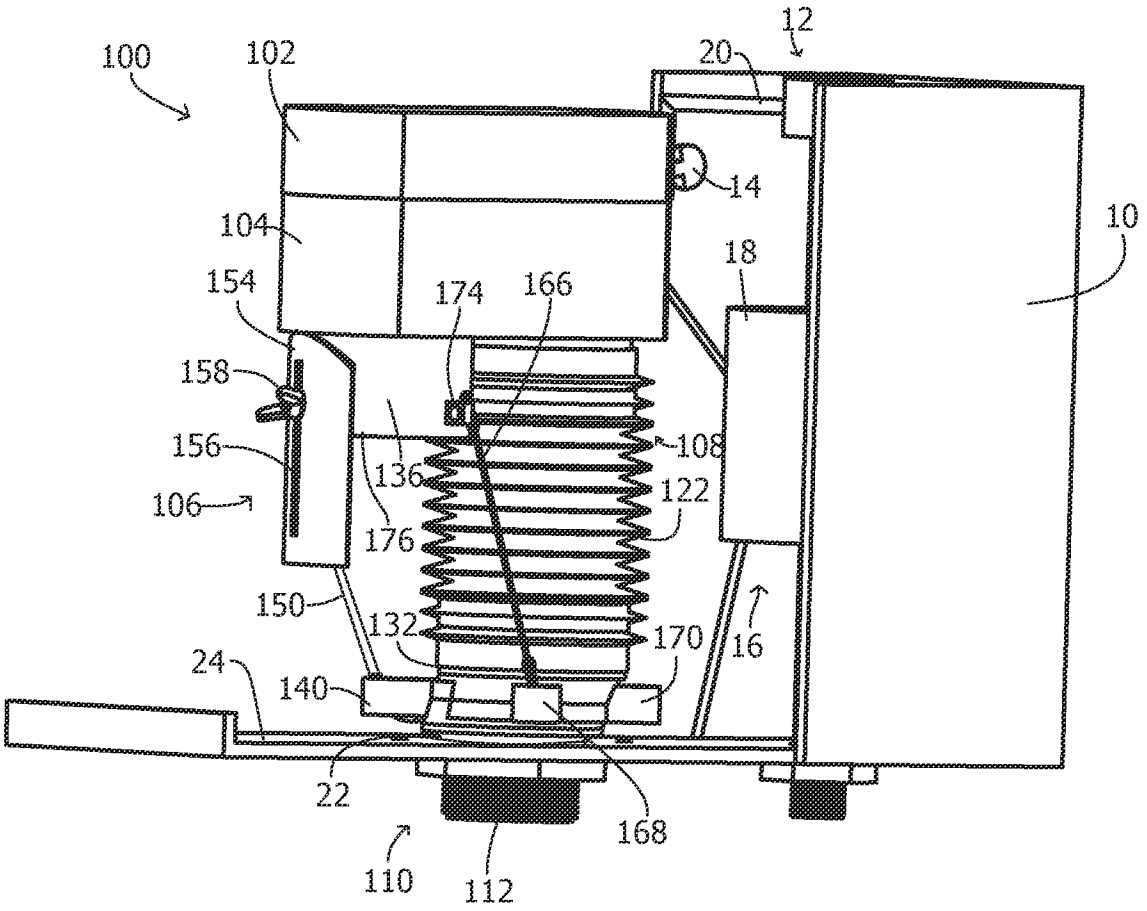

FIGS. 1 and 2 illustrate a flush assembly 100 according to an embodiment of the invention. The flush assembly 100 includes a rigid siphon body 102, a siphon float 104, an inlet assembly 106, an outlet assembly 108, and a drain fitting 110. The flush assembly 100 is configured to be installed in a toilet tank 10 and to interact with a flushing system 12 installed within the toilet tank 10. The flushing system 12 includes a flush handle 14 coupled to a chain 26, and a fill valve assembly 16 with a fill valve float 18 and a refill port 20. It should be understood that the flush assembly 100 can be configured to interact with other types of flushing systems and the toilet tank 10 and the flushing system 12 illustrated and described herein are provided for ease and clarity of description.

Figure 3:
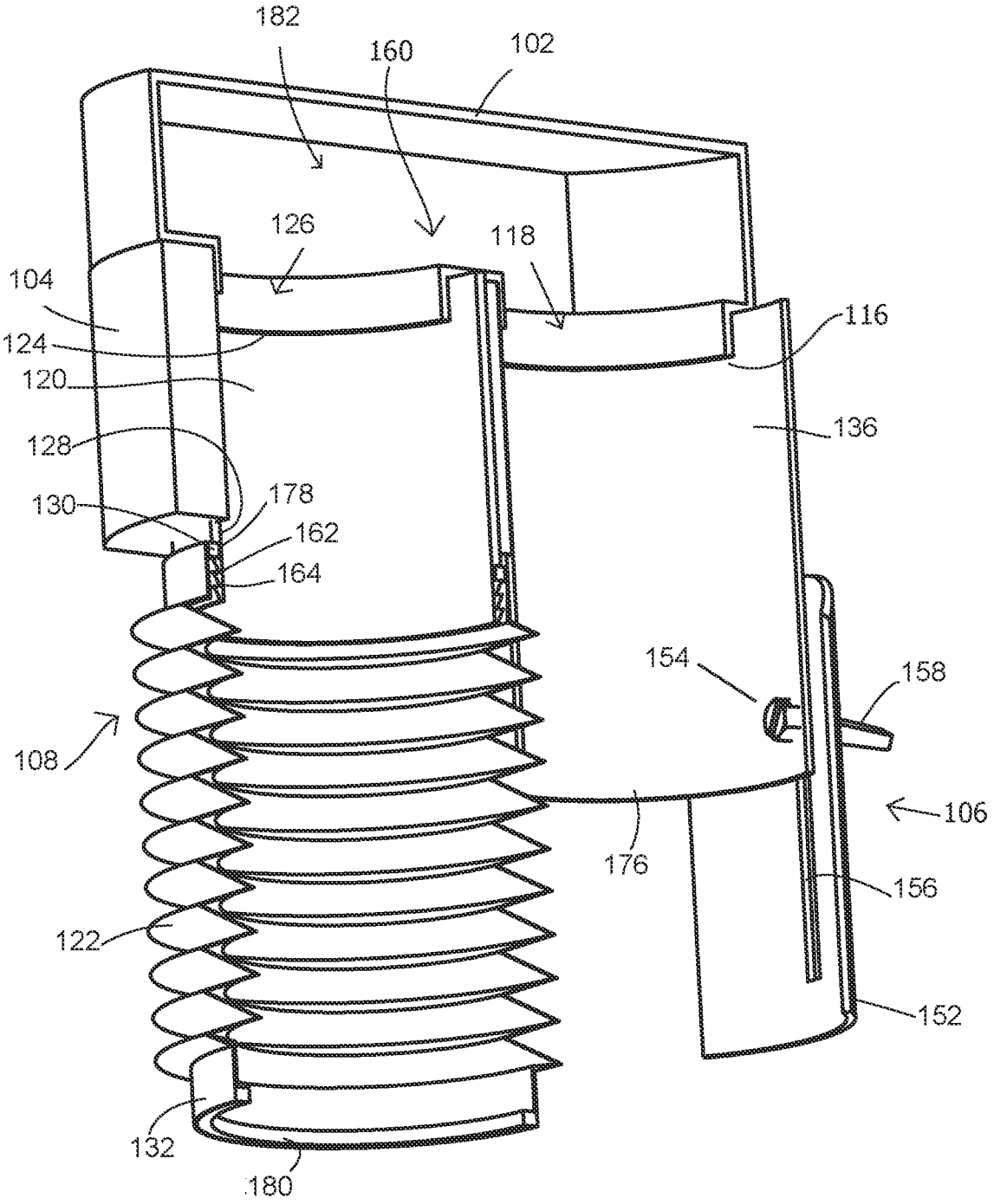
FIG. 3 is a cross-sectional partial view of the flush assembly of FIG. 1 along line 3-3 of FIG. 1.

With additional reference to FIG. 3, The rigid siphon body 102 is formed as a substantially rigid integral shell, from substantially rigid plastic, which defines a siphon inlet 118, a siphon outlet 126, and a siphon passage 160 extending between the siphon inlet 118 and the siphon outlet 126. It is contemplated, however, that the rigid siphon body 102 can be formed from other materials, including non-rigid materials, for example, non-rigid plastic. The rigid siphon body 102 can be configured to define a pressurization cavity 182 along the siphon passage 160. For example, the rigid siphon body 102 can be configured with a flow cross section within an internal part of the rigid siphon body 102 that is somewhat larger than a flow cross section at the siphon inlet 118 or the siphon outlet 126. In this way, for example, as a siphon flow is being established, air trapped within the pressurization cavity 182 can be pressurized or, at a minimum, air that might have otherwise impeded the siphon flow can be trapped in areas of the rigid siphon body 102 that are peripheral to the siphon flow. In some embodiments, this pressurization, or related effects, can supplement the driving force of the hydrostatic head of water in the toilet tank, to further accelerate water flow into the toilet bowl.

Figure 4:
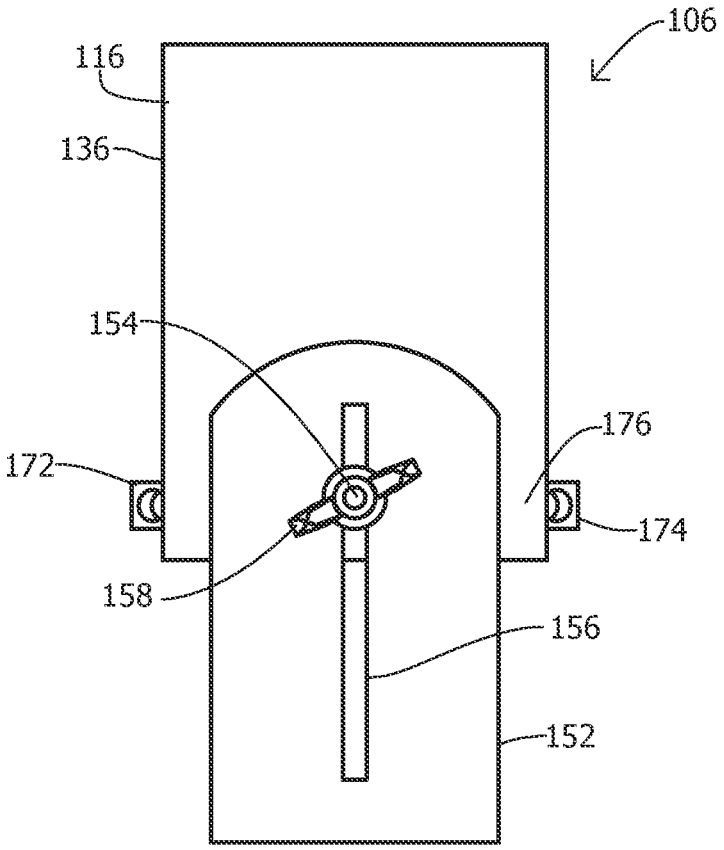
FIG. 4 is a side elevation view of an inlet fitting for the flush assembly of FIG. 1.
Figure 5:
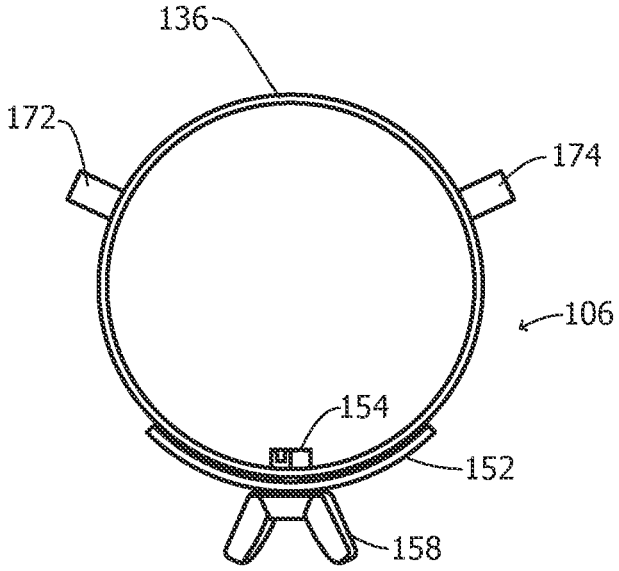
FIG. 5 is top plan view of the inlet fitting of FIG. 4.

The inlet assembly 106 includes an inlet body 136 and a depth stop 152, which is discussed further below with respect to FIGS. 4 and 5. A first end 116 of the inlet body 136 is coupled to the siphon inlet 118 of the rigid siphon body 102. Similar to the rigid siphon body 102, the inlet body 136 can be formed from a substantially rigid plastic, although other materials can be used in some embodiments (for the inlet body 136 or for other components of a flush assembly).

The outlet assembly 108 includes a coupling 120 and a flexible conduit 122, with a first end 124 of the coupling 120 connected to the siphon outlet 126 of the rigid siphon body 102 and a second end 128 connected to a first end 130 of the flexible conduit 122. Like the inlet assembly 106 and the rigid siphon body 102, the coupling 120 can be formed from a substantially rigid plastic.

The connection between the coupling 120 and the flexible conduit 122 is configured to be liquid-tight, which can be achieved through the interfacing of ribs 162, 164 at the second end 128 of the coupling 120 and the first end 130 of the flexible conduit 122. The ribs 162, 164 can have a tooth-like profile that act as a ratchet to further secure the connection the further the flexible conduit 122 is overlapped with the coupling 120. Additionally, or alternatively, the coupling 120 can have a notch extending around the outer periphery at the second end 128 that is configured to receive a similarly shaped flange 178 extending inward at the first end 124 of the flexible conduit 122 to further secure the connection. In some embodiments, adhesive or other joining techniques (e.g., ultrasonic welding) can be used to enhance one or more of these connections.

According to some embodiments of the invention, the flexible conduit 122 can be configured as a corrugated bellows tube, which can be compressed and extended axially. Generally, the flexible conduit 122 is configured to exhibit a compressed length (e.g., when fully compressed), and an extended length (e.g., when fully extended), and any variety of lengths therebetween. The flexible conduit 122 can generally be configured to exhibit any number of extended, resting, and compressed lengths, as may be appropriate for a particular application.

In the embodiment illustrated, the flexible conduit 122 is configured as a default-compressed conduit, exhibiting a resting length that is generally equal to the compressed length. This can be useful, for example, in order to allow the flexible conduit 122 to be relatively easily compressed when the toilet is flushed, or to help reduce initial resistance to actuation of a flushing sequence. In other embodiments, other configurations are possible.

The siphon float 104 is received around and is coupled to the rigid siphon body 102, the inlet body 136, the coupling 120, and the flexible conduit 122. The siphon float 104 can be sized and configured to further enhance the connection of these parts to one another. For example, the siphon float 104 can comprise an elastomeric polymer such as ethylene-vinyl acetate (EVA) foam and can, through its rubber-like characteristic, bind the connections of the inlet body 136 and the rigid siphon body 102, the coupling 120 and rigid siphon body 102, and the coupling 120 and the flexible conduit 122. EVA foam also has exhibits a relatively high level of buoyancy and low-water absorption compared to other polymers, which can increase the effectiveness of the siphon float 104. Other materials or compositions are considered, however. It is further contemplated that an adhesive could be used to retain the connections of the inlet body 136, the rigid siphon body 102, the coupling 120, and the flexible conduit 122.

The flushing system 12 is operatively connected to the flush assembly 100 through a connection between the chain 26 and a flush cable 150 that is routed along the drain fitting 110 and connected on the other end to the inlet assembly 106, and the flushing assembly 100 is fluidly connected with the toilet bowl, through the flush port 22 of the toilet tank 10, by the drain fitting 110. When the flush assembly 100 is installed in the toilet tank 10 and the toilet tank 10 is filled with water, the siphon float 104 keeps the rigid siphon body 102 at or above the water level in the toilet tank 10 and maintains an air pocket in a pressurization cavity 182 within the rigid siphon body 102 and along a siphon flow path between the inlet assembly 106 and the drain fitting 110. Accordingly, although at least a portion of the inlet body 136 of the inlet assembly 106 is disposed below the water level of the toilet tank 10, water will not tend to flow through the rigid siphon body 102 and into the flexible conduit 122 of the outlet assembly 108.

In some implementations, devices or systems disclosed herein can be utilized or installed using methods embodying aspects of the invention. Correspondingly, description herein of particular features or capabilities of a device or system is generally intended to inherently include disclosure of a method of using such features for intended purposes and of implementing such capabilities. Similarly, express discussion of any method of using a particular device or system, unless otherwise indicated or limited, is intended to inherently include disclosure, as embodiments of the invention, of the utilized features and implemented capabilities of such device or system.

In this regard, for example, with respect to the flush assembly 100 disposed as illustrated in FIGS. 1 and 2, a flushing sequence can be started by an operator rotating the flush handle 14 in a counter-clockwise direction (as viewed in the orientation of the flush handle 14 and the flush assembly 100 shown in FIGS. 1 and 2). The chain 26 is pulled upward and away from the bottom of the toilet tank 10 and the flush cable 150 is pulled at least partially along and relative to the drain fitting 110. The flush cable 150 pulls the inlet assembly 106 and the rest of the flush assembly 100, including the rigid siphon body 102, downward toward the bottom of the toilet tank 10. Additionally, or alternatively, an internal lever (not shown) can be coupled to the rigid siphon body 102 and can be actuated to push the rigid siphon body 102 downward within the toilet tank 10.

When (e.g., as) the rigid siphon body 102 is submerged, the hydrostatic pressure of the water within the toilet tank 10 can initiate a flow of water from the toilet tank 10, into the rigid siphon body 102 via the inlet body 136. With sufficient volumetric flow, as can be induced with sufficient submergence of the rigid siphon body 102, the water can substantially fill the siphon flow path within the rigid siphon body 102 so that a siphon-driven flow through the flush assembly 100 is established. The resulting flow, directed through the drain fitting 110 to the toilet bowl (not shown) can thus flush the toilet bowl.

Usefully, because the flow from the toilet tank 10 into the toilet bowl may be primarily siphon-driven, rather than gravity driven as in conventional flush assemblies, the velocity of the flow may be largely independent of the water level within the toilet tank 10. Because the quality of a flush may depend significantly on the velocity of water entering the toilet bowl, this arrangement may result in relatively substantial improvement in flushing performance as compared to conventional systems.

Once appropriately established, the siphon-driven flow can continue, draining the toilet tank 10 into the attached toilet bowl until the water level of the toilet tank 10 falls below the first end 116 of the inlet body 136. It is contemplated that the siphon created within a trap of the toilet that removes the water from the toilet bowl will be broken prior to the siphon-driven flow of the flush assembly in part because of the speed at which the water moves respectively through each system. With the siphon-driven flow of the flush assembly 100 having thus been broken after the siphon through the trap, the remaining water within the outlet assembly 108 fills the toilet bowl. As further discussed below, this can result in more water-efficient refilling of a toilet bowl after a flush, among other benefits.

Continuing, to ensure appropriate filling of the toilet bowl after a flush, it may sometimes be beneficial to configure the outlet assembly 108 with an appropriately large internal volume. The volume of water within the outlet assembly 108 can depend on factors such as the diameter of the coupling 120 and the flexible conduit 122 and also the predetermined distance the flush assembly is stopped above the bottom of the toilet tank 10 as discussed below with respect to a depth stop 152 coupled to the inlet body 136. For example, the outer diameter of the flexible conduit 122 can be about four inches to provide an adequate amount of water to fill the toilet bowl.

With the illustrated arrangement, or other embodiments in which an outlet assembly helps to refill a toilet bowl, there may be no need for a fill valve assembly (e.g., the assembly 12) to have a water line running to an overflow assembly to refill the toilet bowl. Notably, such an arrangement—e.g., with a fill line routing refill flow directly into an overflow tube—can potentially waste water as excess water directed into the toilet blow can flow over the weir of the toilet bowl trap and down the drain. In contrast, for example, as shown in FIG. 1, a refill port 20 can be provided on the fill valve assembly 16 that only refills the toilet tank 10 directly, without being directed into the overflow tube. Thus, as the toilet tank 10 is refilled via the refill port 20, the rising water level in the toilet tank 10 returns the flush assembly 100 back to the position shown in FIGS. 1 and 2, but water from the refill operation is not directed—potentially wastefully—directly into the toilet bowl.

In some embodiments, a refill arrangement such as shown in FIGS. 1 and 2 can be installed as a retrofit assembly into existing toilet tanks. For example, a short length of bendable tube can be provided as part of a retrofit kit. The bendable tube can then be attached to a refill assembly, such as shown for the refill port 20 in FIG. 1, to redirect the refill flow directly into the tank, rather than into an overflow tube.

In some embodiments, it may be useful to limit the height of a floating portion of a flush assembly. For example, referring again to FIGS. 1 and 2 an anchor cable 166 is also depicted. The anchor cable 166 can generally be coupled between the drain fitting 110 and the inlet body 136 to define a stopping distance. In particular, as shown in FIGS. 1 and 2, the cable 166 is attached between a drain fitting tab 170 of a set of drain fitting tabs 168, 170 extending from the drain fitting 110 and an inlet body tab 174 of a set of inlet body tabs 172, 174 on a second end 176 of the inlet body 136. The anchor cable 166 stops the rigid syphon body 102 and the siphon float 104 at a predetermined upper limit of the position of the flush assembly 100 within the toilet tank regardless of the water level within the toilet tank 10. If water level is above the first end 124 of the coupling 120 the water will flow across the siphon passage 160, out the outlet assembly 108 and drain fitting 110, and to the toilet bowl, therefore, providing an overflow system.

In some embodiments, the pressurization cavity 182 can help establish a relatively fast siphon-driven flow. For example, during a flushing operation, but before the pressurization cavity 182 has filled with water, the submerging of the rigid siphon body 102 can pressurize air that is trapped in the pressurization cavity 182. This pressurized air, alone or in combination with other factors, can help to accelerate flow of water within the rigid siphon body 102, in order to quickly and reliably establish an appropriately fast siphon-driven flow.

With additional reference made to FIGS. 4-8, the flush assembly 100 and the component constituent parts are further herein described. Although the parts are discussed below as individual parts, it is contemplated that any combination of the rigid siphon body 102, the inlet body 136, and the coupling 120 could be integrally formed with one another. The inlet assembly 106 is illustrated in isolation in FIGS. 4 and 5 and is shown having an inlet body 136 and the depth stop 152. The depth stop 152 is operatively coupled to the inlet body 136 and is configured to selectively move axially relative to the inlet body 136 to control how far the flush assembly 100 travels downward within the toilet tank 10 when the toilet tank 10 is drained during a toilet flushing sequence. This can prevent the second end 176 of the inlet body 136 from being suctioned onto the bottom wall of the toilet tank 10 as well as allow other optimization of flush performance.

In larger toilet tanks, it may be preferable to stop the flush assembly 100 farther from the bottom of the toilet tank to break the siphon sooner to avoid using more water than necessary to flush the toilet. In smaller toilet tanks, the opposite may be true: it may be preferable to stop the flush assembly 100 closer to the bottom of the toilet tank to provide an adequate flushing of the toilet. In general, therefore, an adjustable stop assembly can allow users to optimize performance of a flush assembly to the characteristics of a particular, such that a sufficient volume of water per flush is used, to clear the toilet bowl, while excessive use of water per flush is avoided.

In some embodiments, an adjustable stop assembly can also allow users to optimize toilet refill operations. As discussed above, for example, some embodiments may refill a toilet bowl with residual water within an outlet assembly of a flush assembly (e.g., water within the flexible conduit 122). And the amount of residual water once a flushing siphon is broken will generally depend on the depth at which downward travel of the flush assembly within a tank is stopped. Thus, in addition to controlling the total amount of water that is flushed from a tank into a bowl, adjustment of a stop assembly can also control the amount of water that is used to refill the toilet bowl.

Further in this regard, some embodiments can allow users or manufacturers to customize the interoperation of certain components for optimal overall flushing performance. For example, some embodiments may allow customizable optimization of flush and refill volumes of water via adjustment of the internal volume of an outlet assembly and of the depth permitted by a stop assembly, such as via adjustment of a stop assembly and selection of a bellows with a corresponding optimal diameters or other geometric characteristic.

In one example, the inlet body 136 can have a threaded stud 154 extending outward therefrom and configured to be receivable within a slot 156 in the depth stop 152. A nut 158 can be sized to be received on the threaded stud 154 and can be tightened to secure the depth stop 152 in a fixed connection with the inlet body 136 at a predetermined location along the slot 156. It should be noted that this is one example of a way to adjust the depth to which the flush assembly 100 can be limited and other configurations are contemplated.

Figure 6:
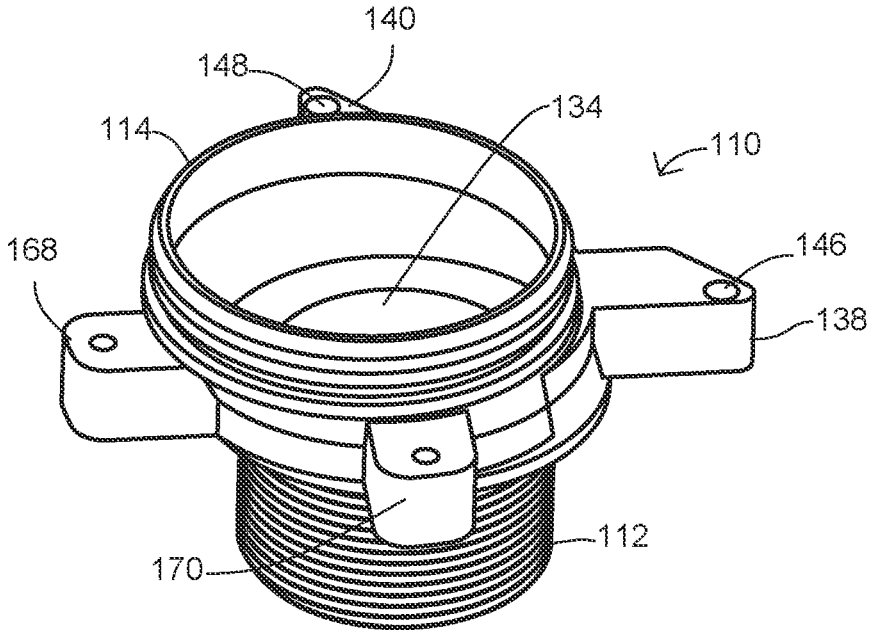
FIGS. 6 and 7 are isometric views of a drain fitting for the flush assembly of FIG. 1.
Figure 7:
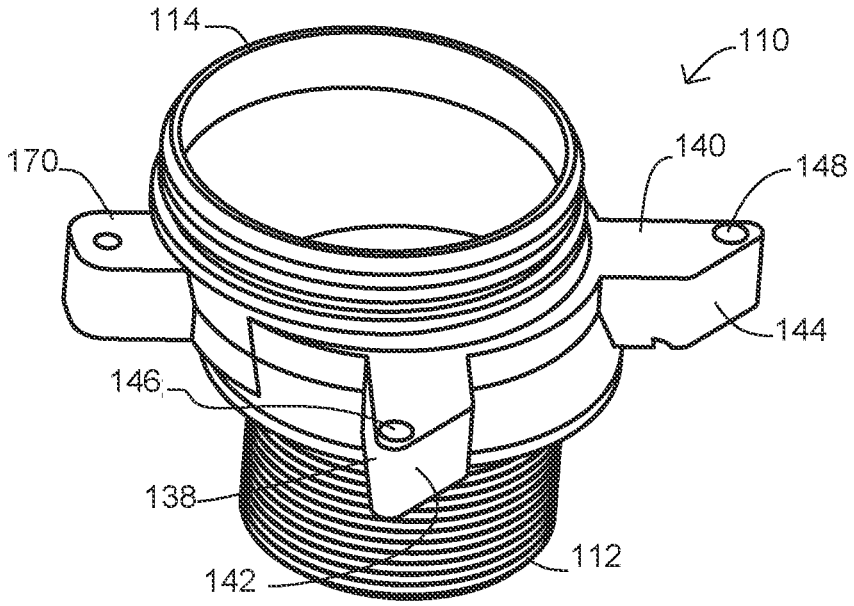
Figure 8:
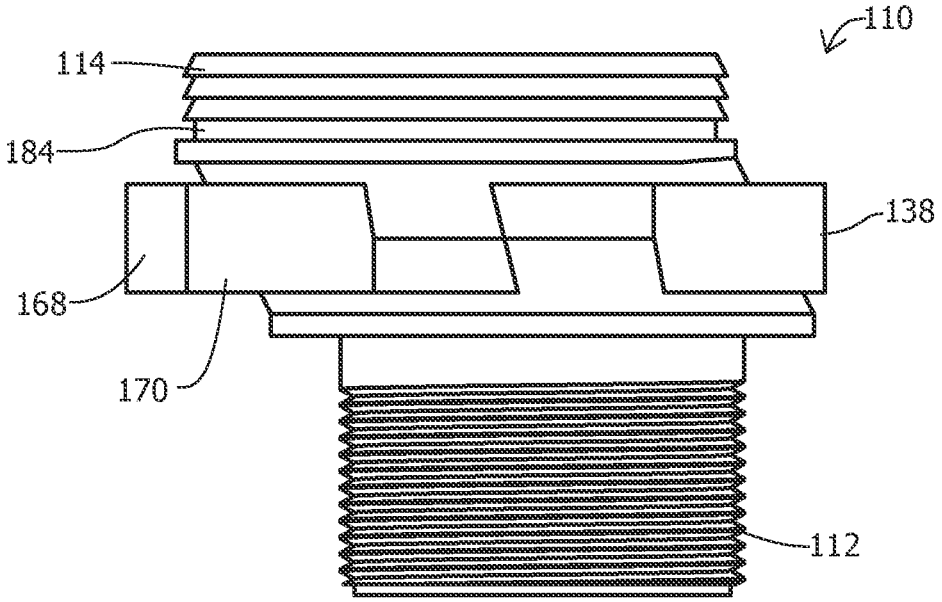
FIG. 8 is a side elevation view of the drain fitting of FIG. 6.

FIGS. 6-8 illustrate the drain fitting 110 of the flush assembly 100. Generally, a drain fitting is configured to be secured to a flush port 22 in a base wall 24 of the toilet tank 10 to provide a terminus, at the flush port 22, for a flow path through a flush assembly. In the illustrated embodiment, the drain fitting 110 includes an extension 112 configured to extend through the flush port 22 (shown in FIG. 1), and a tube connector configured as a conduit seat 114, which is configured to be disposed inside of the toilet tank 10 and connected to the end 132 of the flexible conduit 122 opposite the end 130 connected to the coupling 120. In the embodiment illustrated for the flush assembly 100, the extension 112 is a threaded extension, which may assist in relatively easy attachment of the drain fitting 110 to the toilet tank 10. However, other configurations are contemplated.

In some embodiments, the conduit seat 114 can generally exhibit a larger characteristic width (e.g., diameter) than the extension 112. This may be useful, for example, to provide an appropriate seat for the flexible conduit 122. Similar to the first end 130 of the flexible conduit 122, the connection of the second end 132 is configured to be liquid-tight and can include a flange 180 extending inward that can be received within a groove 184 along the outer periphery of the conduit seat 114 to better secure the connection therebetween. It is further contemplated that a hose clamp can be used to secure the second end 132 of the flexible conduit 122 to the conduit seat 114 of the drain fitting 110. In some embodiments, adhesive or other joining techniques (e.g., ultrasonic welding) can be used to enhance one or more of these connections.

The drain fitting 110 further includes a first arm 138 and second arm 140 extending radially outward from a portion between the extension 112 and the conduit seat 114. The first and second arms 138, 140 are oriented approximately perpendicular to each other. The first and second arms 138, 140 can be configured and shaped to extend toward a wall of the toilet tank 10 and can be shaped accordingly. For example, the first and second arms 138, 140 each have a surface 142, 144, respectively, that can provide clearance relative to the tank wall. In some embodiments, similar surfaces can be configured to contact the tank wall to prevent rotation of the drain fitting 110 during installation and use.

Generally, the arms 138, 140 are configured to support a cable for initiation of a flushing operation. In this regard, for example, each of the first and second arms 138, 140 has a hole 146, 148 configured to receive the flush cable 150 therethrough as shown in FIGS. 1 and 2. The first and second arms 138, 140 and the placement of the holes 146, 148 are configured to support the flush cable 150, so the chain 26 of the flushing system 12 that is connected between the flush handle 14 and the flush cable 150 is kept from contacting the flush assembly 100, and more specifically, the flexible conduit 122 and the float 104. The flush cable 150 can be disposed within a sheathing extending between the first and second arms 138, 140 to promote ease of movement of the flush cable 150 in and between the first and second arms 138, 140.

In some embodiments, a drain fitting can be configured to provide a liquid-tight seal with a toilet tank at a flush port. For example, a gasket, such as a tapered gasket (not shown), can be formed with or seated on the drain fitting 110. In this regard, for example, using the threads on the extension 112 to secure the drain fitting 110 at a flush port can compress a gasket at the flush port in order to prevent water from flowing out of the flush port, except through the interior of the extension 112 (e.g., through the drainage port 134).

In some embodiments, also as illustrated in FIGS. 6-8, the conduit seat 114 can be eccentrically disposed relative to the extension 112, and relative to a drainage port 134 through the extension 112. This may be useful, for example, to allow for an appropriately wide profile of the conduit seat 114, while also allowing the drain fitting 110 to be appropriately installed in toilet tanks in which a flush port is eccentrically located or is otherwise subject to (or itself imposes) space restrictions. In some embodiments, eccentric arrangements, such as is illustrated in FIGS. 4-6, can assist in appropriately installing a siphon arrangement, such as the arrangement included in the flush assembly 100, in even a relatively narrow tank (e.g., as measured front to back). For example, the illustrated eccentric configuration of the drain fitting 110 helps to provide appropriate clearance between the flush lever (extending from the flush handle 14) and the float 104 (etc.), so that neither interferes with the operation of the other.

It is further contemplated that the conduit seat 114 can allow the rigid siphon body 102 and the inlet assembly 106 to be rotated relative to the outlet assembly 108 and the drain fitting 110 for installation of the flush assembly 100 in toilet tanks in which a flush handle is located on the other side of the front of the toilet tank. In that instance, the flush cable 150 still extends through the first and second arms 138, 140 of the drain fitting 110 and is connected to the inlet tab 174 of the set of inlet body tabs 172, 174, but moves in an opposite direction to initiate flushing. And the anchor cable 166 is connected between the drain fitting tab 170 of the set of drain fitting tabs 168, 170 and inlet body tab 172 of the set of inlet body tabs 172, 174.

Figure 9A:
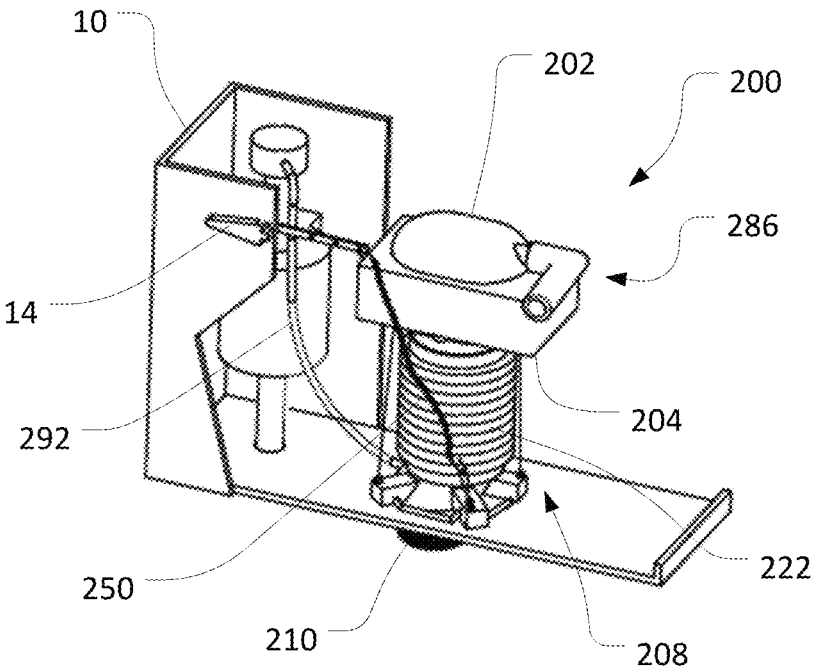
FIGS. 9A and 9B are isometric views of another flush assembly according to an embodiment of the invention, installed in a toilet tank, at two different settings.
Figure 9B:
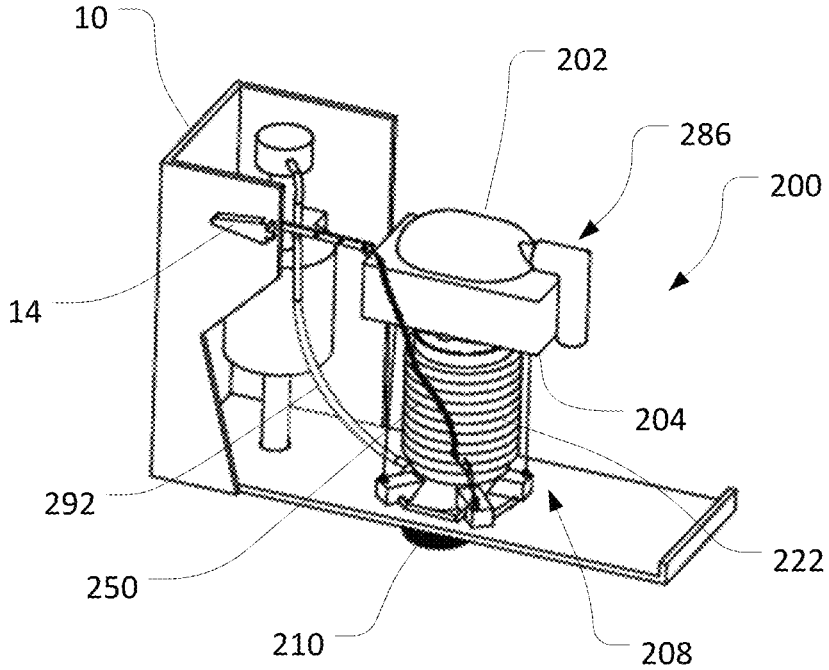
Figure 10:
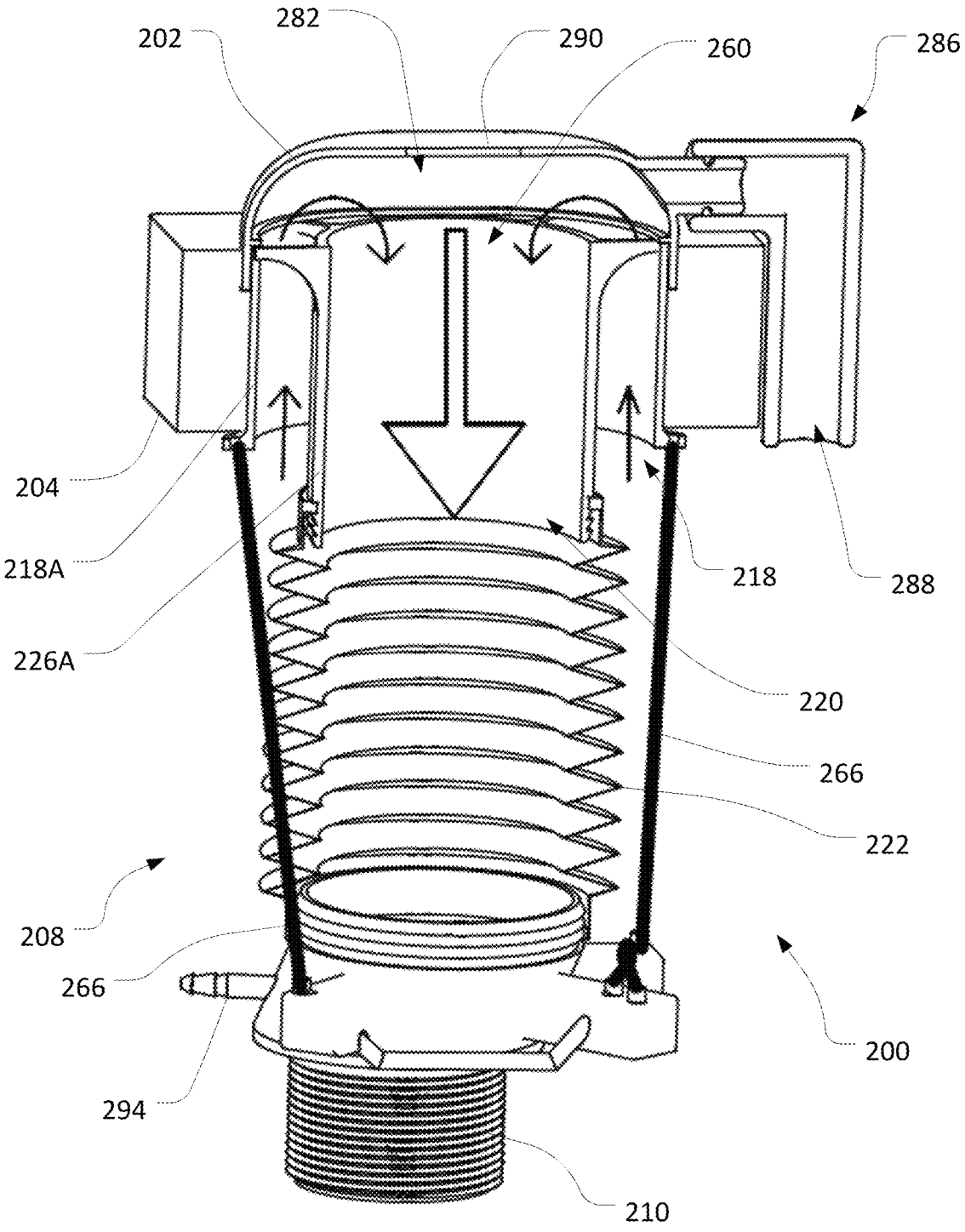
FIG. 10 is a cross-sectional partial view of the flush assembly of FIGS. 9A and 9B.

FIGS. 9A through 10 illustrate another example flush assembly 200 installed within the tank 10. The flush assembly 200 is configured to operate generally similarly to the flush assembly 100, and includes a siphon body 202 configured for similar operations. In particular, as shown in FIG. 10, the siphon body 202 is a multi-piece assembled body, with a siphon inlet 218, a siphon outlet 226, an internal siphon passage 260, and a pressurization cavity 282. As similarly discussed and illustrated relative to the flush assembly 100, when the flush handle 14 (see FIGS. 9A and 9B) is actuated, corresponding tension on a flush cable 250 can submerge a siphon float 204 so that a siphon flow is established through the siphon body 202 and an outlet assembly 208, including an attached flexible conduit 222 and a drain fitting 210, and the attached toilet bowl (not shown) can correspondingly be flushed.

In some aspects, however, the flush assembly 200 differs from the flush assembly 100. For example, in the illustrated example, the siphon body 202 includes an adjustable siphon break 286 that can be selectively positioned to adjustably set a minimum water level during the flushing sequence. Generally, the siphon break 286 is configured to be selectively moved so that an air inlet 288 (see FIG. 10) on the siphon break 286 is positioned at a different height within the tank 10 relative to the remainder of the siphon body 202. Thus, as water level decreases in the tank 10 due to a flushing sequence (i.e., with siphon flow of water to the bowl via the siphon body 202), air flow into the siphon body 202 via the siphon break 286 will be blocked—and then permitted—depending on the height of the siphon body 202 relative to the water level within the tank 10. During an initial submergence of the siphon body 202, the siphon break 286 may thus not prevent a siphon flow from being established. However, once the water level in the tank 10 has fallen to below the adjusted position of the air inlet 288, air flow through the siphon break 286 can disrupt the siphon and thereby cease flow from the tank 10 to the bowl (not shown) via the flush assembly 200.

Generally, a wide variety of movable vent passages can be provided with similar effect as the siphon break 286. In particular, the siphon break 286 is formed as a fully rotatable elbow tube with an outlet at the pressurization cavity 282. However, other angled tubes, other rotatable tubes, and other types and locations of vent passages are also possible, as may be configured to provide an adjustable air-inlet height and thereby determine (in combination with buoyancy behavior and other characteristics of a flush assembly) a water level within a tank at which a siphon flow for a flushing sequence will be broken. Likewise, although FIGS. 9A and 9B in particular show a potential maximum water height setting and potential minimum water height setting, respectively, a variety of other options are possible.

Figure 11:
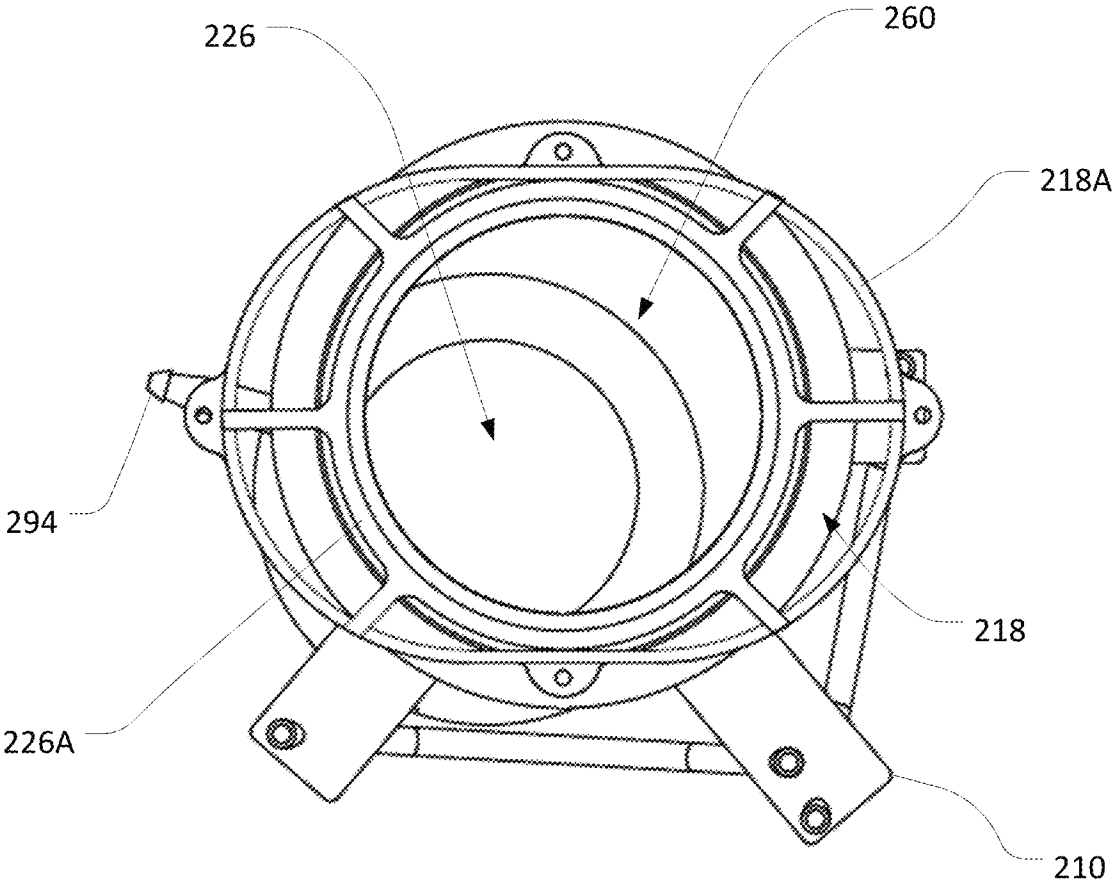
FIG. 11 is a top view of certain components of the flush assembly of FIGS. 9A and 9B.

Referring now also to FIGS. 10 and 11, the siphon body 202 is also constructed somewhat differently than the siphon body 102, as may more rapidly and efficiently establish siphon flow during a flushing sequence. In particular, in the illustrated example, the siphon body 202 is formed as a concentric assembly, with an outlet tube 226A that internally defines part of the siphon passage 260, an inlet tube 218A that extends concentrically with and radially to the outside of the outlet tube 226A and defines, along with the outlet tube 226A, an annular configuration for the siphon inlet 218. Thus, as shown by arrows in FIG. 10, when the float 204 is appropriately submerged, a radially arranged, concentric siphon flow can be established up through the inlet tube 218A and then down through the outlet tube 2226A to the flexible conduit 222, etc.

Still referring to FIG. 10, the inlet tube 218A can advantageously provide a unifying connecting structure for the siphon body 202 as a whole, as may simplify manufacturing and improve durability and general functionality. In particular, in the illustrated example, the inlet tube 218A supports the radially-external siphon float 204, the radially-internal outlet tube 226A, anchor cables 266 (or other cables, including to activate a flush sequence), and a cap 290 that in turn provides the pressurization cavity 282, supports the adjustable siphon break 286, and generally completes the siphon passage 260 between the siphon inlet 218 and the siphon outlet 226.

In different cases, an inlet tube and outlet tube can exhibit different geometries while still promoting appropriate siphon flow in a concentric arrangement. For example, as shown in FIG. 11 in particular, the inlet tube 218A is generally oblong in cross-section, whereas the outlet tube 226A is generally circular in cross-section. Further, in the illustrated example, the local width of the siphon inlet 218 thus varies with angular orientation around the outlet tube 226A, with maximum flow area in alignment with the siphon break 286 and minimum flow area at a 90-degree offset therefrom. This arrangement may be particularly beneficial for effectively establishing and breaking siphon flow, although other configurations are also possible.

In some embodiments, as also discussed above, it may be helpful for a refill tube (i.e., for refilling a toilet bowl) is not directed directly into an overflow tube. In this regard, for example, as shown in FIGS. 9A and 9B in particular, a refill tube 292 connects directly to a refill port 294 on the drain fitting 210 to directly refill the bowl via the drain fitting 210. In other embodiments, for example, the refill tube 292 can be similarly connected to other locations (e.g., other ports) along the outlet assembly 208.

The FIGS. discussed above illustrate certain components of flush assemblies 100, 200 which are illustrated as assembled and installed in the toilet tank 10 in some FIGS. The configuration of these components for, and their inclusion in, the flush assemblies 100, 200 is presented as an example only. In other embodiments, other components and other configurations are possible. For example, any one or more of the floats or other components of the flush assembly 100 can be used for similar purposes in the flush assembly 200 and vice versa.

Thus, embodiments of the invention can provide improved flush assemblies as compared to conventional arrangements. In some embodiments, for example, use of a siphon-driven flush assembly according to the invention can allow flush-port flaps or other similar components to be eliminated from a toilet tank, thereby improving the resistance to leakage from the tank into the associated toilet bowl. Further, in some embodiments, a siphon-driving flush assembly can provide flushing flows of relatively high velocity regardless of the water level in the relevant tank. In contrast, for example, conventional, gravity-driven flush assemblies tend to exhibit reduced flushing velocity as the water level in the relevant tank decreases.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A flush assembly for a toilet with a tank that includes a flush port and a flush handle, the flush assembly comprising:

a siphon body with a siphon inlet, a siphon outlet, and a siphon passage;

an outlet assembly coupled to the siphon outlet;

a drain fitting coupled to the outlet assembly and configured to be coupled to the tank at the flush port, the drain fitting having a set of arms extending radially outward therefrom; and a flush cable movably secured to the set of arms, and coupled to the flush handle and the siphon body at opposing ends of the flush cable;

the siphon body being configured:

to float within the tank between flushing sequences; and during a flushing sequence, to be submerged by the flush handle, via the flush cable, to establish a siphon-driven flow of liquid from the tank to the flush port to flush the toilet via, successively, flow through the siphon inlet, the siphon passage, the siphon outlet, the outlet assembly, and the drain fitting.

2. The flush assembly of claim 1, further comprising a siphon float configured to support the siphon body to cause the siphon body to float within the tank.

3. The flush assembly of claim 2, wherein the siphon inlet and the siphon passage extend through the siphon float concentrically with each other.

4. The flush assembly of claim 1, further comprising an anchor cable coupled between the drain fitting and the siphon body, wherein the anchor cable is configured to stop the siphon body at a predetermined upper limit within the toilet tank.

5. The flush assembly of claim 1, wherein the siphon inlet is arranged radially around the siphon passage.

6. The flush assembly of claim 5, wherein the siphon inlet is defined by an inlet tube that surrounds the siphon passage and supports a cap of the siphon body and a siphon float; and wherein the cap forms a pressurization cavity within the siphon body.

7. The flush assembly of claim 6, wherein the siphon body further includes an adjustable siphon break in communication with the pressurization cavity.

8. The flush assembly of claim 1, further comprising an inlet assembly coupled to the siphon inlet, including a depth stop configured to limit the depth the siphon body is submerged during the flushing sequence;

wherein the depth stop is adjustable relative to the siphon body to modify a minimum distance between the siphon inlet and a floor of the tank when the siphon body is submerged during the flushing sequence.

9. The flush assembly of claim 1, wherein the siphon body further includes an adjustable siphon break, the adjustable siphon break including a movable vent passage configured to be selectively positioned to determine a minimum water level during the flushing sequence.

10. The flush assembly of claim 9, wherein the movable vent passage includes a rotatable, angled tube.

11. A flush assembly for a toilet with a tank that includes a flush port and a flush handle, the flush assembly comprising:

a siphon body with a siphon inlet, a siphon outlet, and a siphon passage;

an outlet assembly coupled to the siphon outlet to direct flow from the siphon outlet to the flush port, the outlet assembly including an expandable bellows; and a siphon break assembly in fluid communication with the siphon inlet;

the siphon body being configured:

to float within the tank; and during a flushing sequence, to be submerged to establish a siphon-driven flow of liquid from the tank to the flush port to flush the toilet via, successively, flow through the siphon inlet, the siphon passage, the siphon outlet, and the outlet assembly; and the siphon break assembly being adjustable relative to the siphon inlet to modify a minimum water level within the tank during the flushing sequence.

12. The flush assembly of claim 11, wherein the expandable bellows is configured to retain sufficient water, upon cessation of a siphon that drives the siphon-driven flow, to refill a bowl of the toilet.

13. The flush assembly of claim 12, further comprising:

a refill tube configured to refill the toilet after cessation of the siphon-driven flow; and an overflow tube to prevent overflow of the tank;

wherein the refill tube is configured not to direct a refill flow directly into the overflow tube.

14. The flush assembly of claim 13, wherein the refill tube is configured to direct the refill flow via a port on the outlet assembly.

15. A flush assembly for a toilet with a tank that includes a flush port and a flush handle, the flush assembly comprising:

a siphon body with a siphon inlet, a siphon outlet, and a siphon passage;

an outlet assembly coupled to the siphon outlet to direct flow from the siphon outlet to the flush port, the outlet assembly including an expandable bellows; and a refill port;

the siphon body being configured:

to float within the tank; and during a flushing sequence, to be submerged to establish a siphon-driven flow of liquid from the tank to the flush port to flush the toilet via, successively, flow through the siphon inlet, the siphon passage, the siphon outlet, the outlet assembly, and the drain fitting; and the refill port being configured to refill the tank after cessation of the siphon-driven flow, without directing a refill flow directly into an overflow tube of the tank.

16. The flush assembly of claim 15, wherein the siphon body includes a cap that is configured to define a pressurization cavity along the siphon-driven flow between the siphon inlet and the siphon outlet.

17. The flush assembly of claim 15, wherein the siphon body further includes a siphon break assembly that is rotatably adjustable relative to the siphon inlet to modify a minimum water level within the tank during the flushing sequence.

18. The flush assembly of claim 17, wherein the siphon break assembly includes a rotatable elbow tube.

19. The flush assembly of claim 15, wherein the siphon inlet is defined by an inlet tube that surrounds the siphon passage and supports a cap of the siphon body and a siphon float.

20. The flush assembly of claim 19, wherein the siphon inlet and the siphon passage extend through the siphon float concentrically with each other.

* * * * *